US006299553B1

(12) United States Patent
Petuchowski et al.

(10) Patent No.: US 6,299,553 B1
(45) Date of Patent: Oct. 9, 2001

(54) GOLF STROKE TALLY SYSTEM METHOD

(76) Inventors: Daniela C. Petuchowski; Samuel Judah Petuchowski, both of 62 Clark Rd., Brookline, MA (US) 02445

( * ) Notice: Subject to any disclaimer, the term of this patent is extended or adjusted under 35 U.S.C. 154(b) by 0 days.

(21) Appl. No.: 09/394,570

(22) Filed: Sep. 10, 1999

Related U.S. Application Data

(60) Provisional application No. 60/099,911, filed on Sep. 11, 1998.

(51) Int. Cl.[7] ..... A63B 57/00
(52) U.S. Cl. ..... 473/409; 473/283; 473/223
(58) Field of Search ..... 473/220, 224, 473/221, 223, 409, 283

(56) References Cited

U.S. PATENT DOCUMENTS 4,864,592 * 9/1989 Lee ..... 473/224
4,940,236 * 7/1990 Allen ..... 473/223
5,277,428 * 1/1994 Goodwin et al. ..... 473/220
5,441,269 * 8/1995 Henwood ..... 473/220
5,487,542 * 1/1996 Foley ..... 473/409
5,492,329 * 2/1996 Kronin ..... 473/220
5,527,036 * 6/1996 Hutchings et al. ..... 473/220
5,550,884 * 8/1996 Berney ..... 473/224

* cited by examiner

*Primary Examiner*—Mark S. Graham
*Assistant Examiner*—Raeann Gorden

(57) ABSTRACT

An automatic tally unit and a method for enabling a golfer to keep a running electronic tally of strokes played during the course of a game of golf. The golf score tally device records a number of golf strokes taken with a golf club on a portion or entirety of a golf course. The golf score tally device has a sensor for selectively generating a signal when a golf ball is struck by the golf club, and a processor for tallying a number of strokes based at least on the signal.

7 Claims, 6 Drawing Sheets

GOLF STROKE TALLY SYSTEM METHOD

The present application claims priority from U.S. provisional application No. 60/099,911, filed Sep. 11, 1998, and incorporated by reference.

TECHNICAL FIELD

The present invention relates to a method of tallying golf strokes as for a game of miniature golf, and to a golf score tally device for performing the method.

BACKGROUND ART

The traditional method of tallying golf strokes by hand on a score card is both cumbersome and prone to error, and, additionally, detracts from enjoyment of the game.

SUMMARY OF THE INVENTION

In accordance with one aspect of the invention, in a preferred embodiment, there is provided a golf score tally device for recording a number of golf strokes taken with a golf club on a portion of a golf course up to the entirety thereof. The golf score tally device has a sensor for generating a signal when a golf ball is struck by the golf club, and a processor for tallying a number of strokes based at least on the signal.

In accordance with an alternate of the invention, there is provided a golf club with integral scope tallying capability. The golf club has a shaft with a proximal end and a distal end, and a head coupled to the shaft at the distal end for striking a golf ball. Additionally, the golf club has a sensor for generating a signal when a golf ball is struck by the head, and a processor for tallying a number of strokes based at least on the signal. In accordance with alternate embodiments of the invention, the golf club may also have a memory for storing the number of strokes, a display for displaying the number of strokes, and a transponder for communication between the processor and the golf course.

BRIEF DESCRIPTION OF THE DRAWINGS

The invention will be more readily understood by reference to the following drawings, taken with the accompanying detailed description, in which.

DETAILED DESCRIPTION OF SPECIFIC EMBODIMENTS

Figure 1:
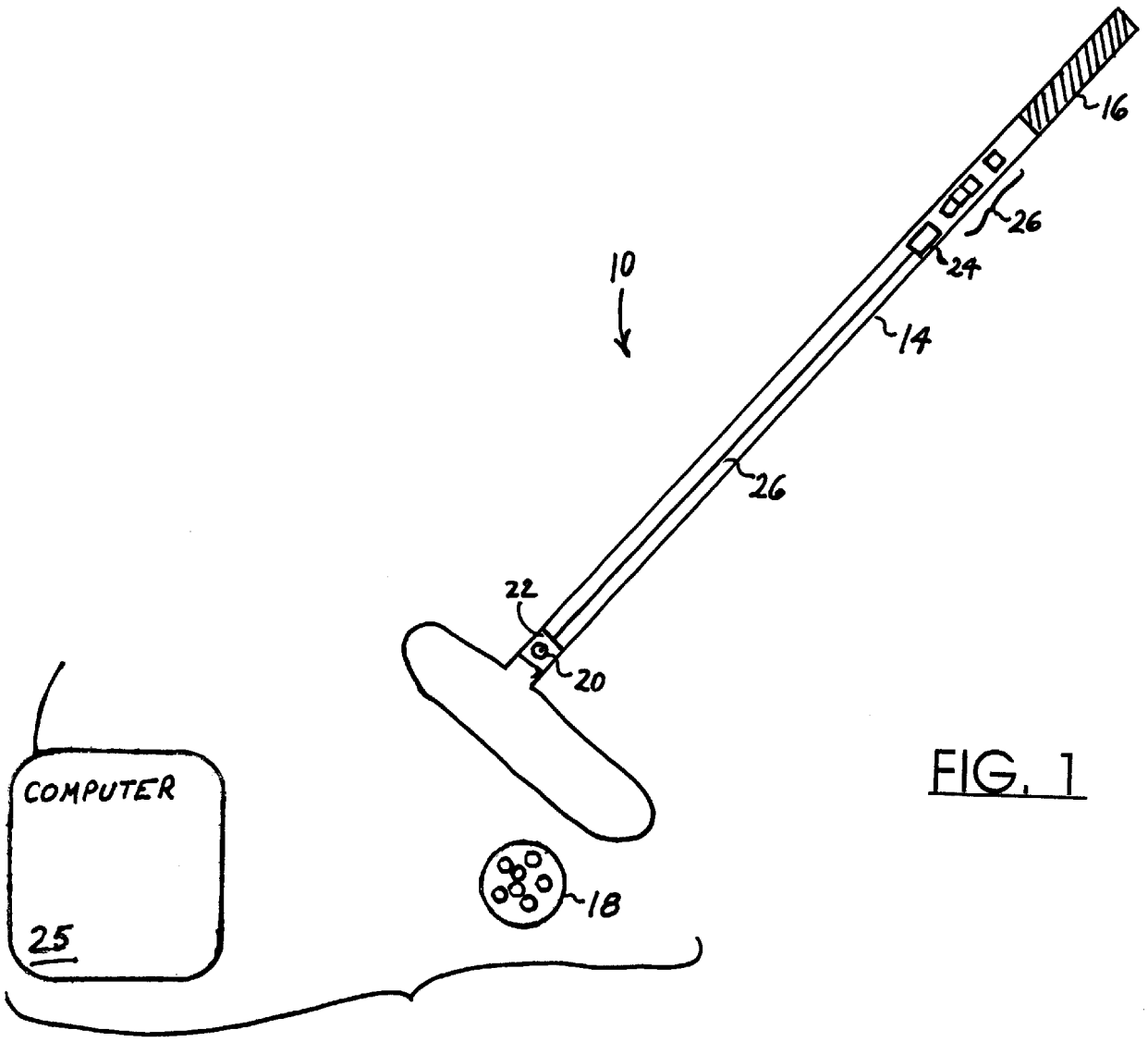
FIG. 1 is a side view of a golf club showing a transducer band and a display band in accordance with an embodiment of the present invention.

The present invention provides an acoustic tally unit that enables a golfer to keep a running electronic tally of strokes played on a given hole as well as a cumulative tally of strokes played in a game. The term "stroke," as used in this description and in any appended claims, refers to movements of a golf club resulting in the head of the golf club making contact with a ball.

In accordance with a further embodiment of the invention, scores of multiple players may be centrally tallied and a score sheet may be provided to a party of players at the completion of an entire round of golf or at any stage of the game prior thereto.

A preferred embodiment of the invention is described with reference to FIG. 1, wherein a side view is shown of a golf club designated generally by numeral 10. Golf club 10 has a head 12, a shaft 14, and a grip 16. All designs of golf club, whether for driving or putting purposes, are within the scope of the present invention as described herein and as claimed in any appended claims. When club 10 is used to strike ball 18, in the manner of any elastic rigid body, is initially compressed due to the force of head 12 acting upon its outer surface. Momentum may be transferred to ball 18 no faster than the propagation of longitudinal waves through the volume of the ball, i.e., the speed of sound in the ball. Some fraction of the kinetic energy of the swinging club is transferred to the ball during the course of the interaction of the club with the ball, that fraction reflecting the efficiency of mechanical coupling (or 'matching') between the club and the ball. The force of the club acting upon ball 18 results, in accordance with Newton's Third Law, in an equal and opposite force acting upon head 12.

As discussed in greater detail below, compression and restoration of the shape of ball 18 is characterized by a frequency which depends on the ratio of the mass and a characteristic elastic parameter (effectively a 'spring modulus') of the ball. The dependence is weak (substantially as the square root of the ratio) and thus substantially constant across a sample of golf balls used in, say, miniature golf. Since the mechanical coupling between the club and the ball is imperfect, some fraction of the energy coupled into the ball, and converted momentarily to potential energy in the form of compression of the ball, is returned to the club, modulated at the characteristic frequency of the ball. By sensing the returned energy, by means, for example, of transducer 20 attached to shaft 14 by transducer ring 22, a preferred embodiment of the present invention senses that ball 18 has been struck by club 10. Occurrences of club 10 striking ball 18 may be distinguished from occurrences of club 10 striking other objects or otherwise being acoustically excited by electronic filtering methods, as described below, in signal processor 24 coupled to shaft 14.

Signal processor 24 receives an output signal of transducer 20 via an electrical connecting wire 26, or by wireless transponder means of telemetering signal data as known to persons of ordinary skill in the instrumentation arts. Strokes of club 10 against ball 18 may be registered, locally or centrally, and may be displayed on a display band 26 which may provide the player with such numerical data as the current hole being played, the current number of strokes taken on the current or previously played hole, or a cumulative number of strokes since the beginning of play or since a specified hole or juncture of the game.

Data may be exchanged, in accordance with alternate embodiments of the present invention, between local processor 24 and a central computer 25 so that scores of multiple players may be centrally tabulated, and so that information as to the current hole being played, etc., may be provided to local processor 24 for display.

Figure 2A:
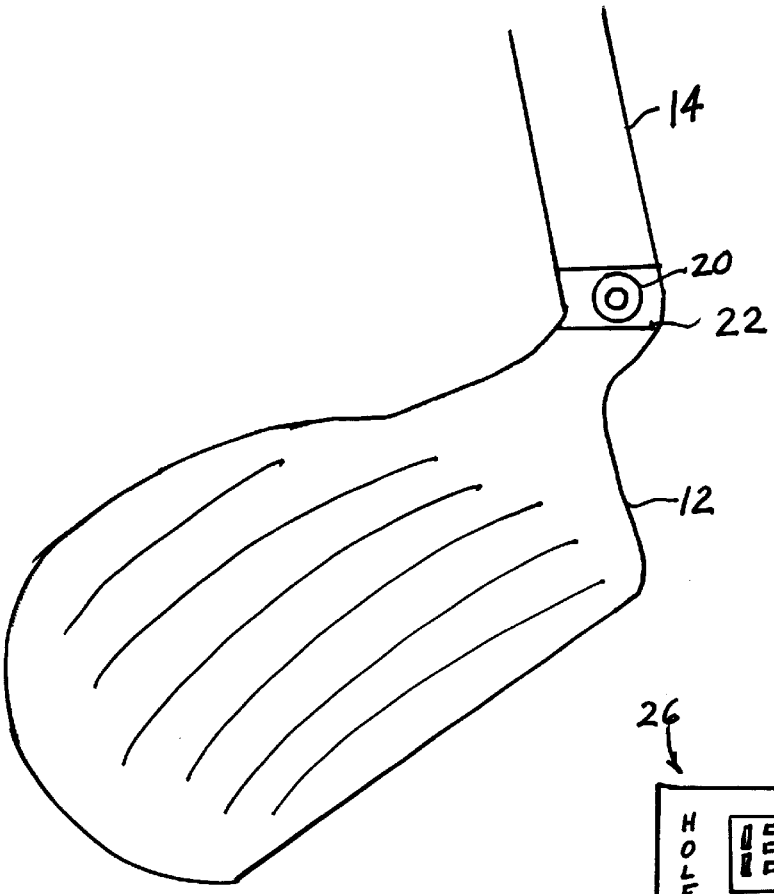
FIGS. 2*a*–2*c* show the components of the embodiment of FIG. 1 in greater detail.
Figure 2B:
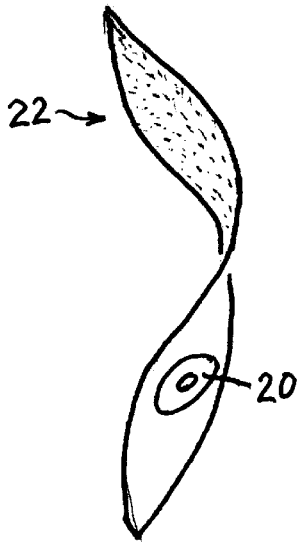
Figure 2C:
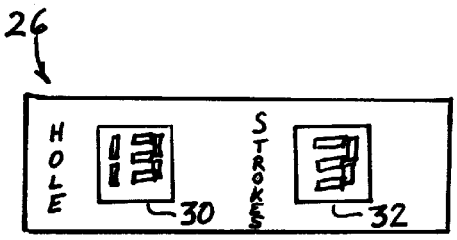

Referring now to FIGS. 2*a*–2*c*, the golf score tally device, in accordance with the embodiment shown in FIG. 1, is shown in greater detail. Transducer band 22 is shown surrounding shaft 14 in proximity to head 12. Transducer band 22 may be secured for preventing slippage and for improving acoustic coupling to transducer 20 by adhesion of inner surface 28 of the transducer band. Transducer 20 may be any transducer known in the art for converting acoustic waves within a solid to an electrical signal. In a preferred embodiment of the invention, a piezoelectric transducer is employed. Display band 26 is shown in FIG. 2*c* in accordance with one embodiment, where separate two-digit and one-digit liquid crystal displays, designated by numerals 30 and 32, respectively, are used to display the number of the hole currently being played and the number of strokes taken on the current hole.

Figure 3A:
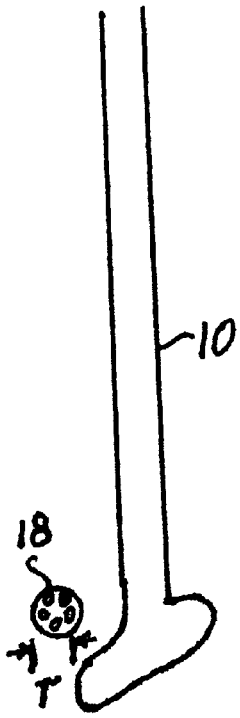
FIGS. 3*a*–3*c* depict successive views of a golf club and a golf ball during the course of a stroke.
Figure 3B:
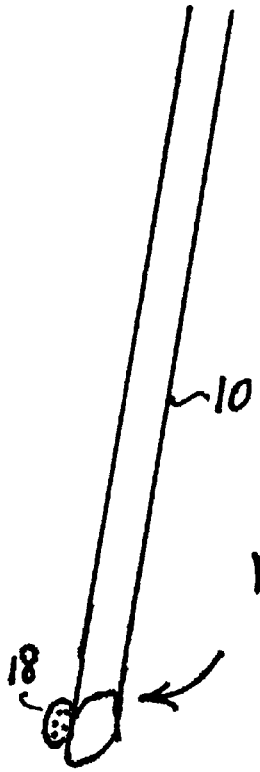
Figure 3C:
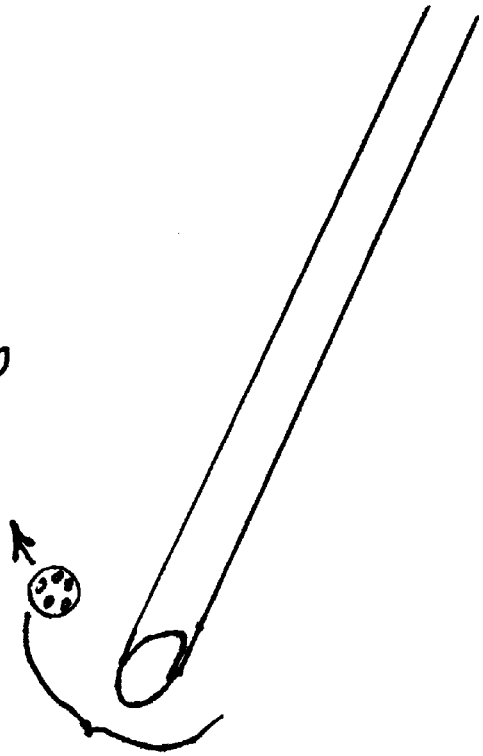
Figure 4:
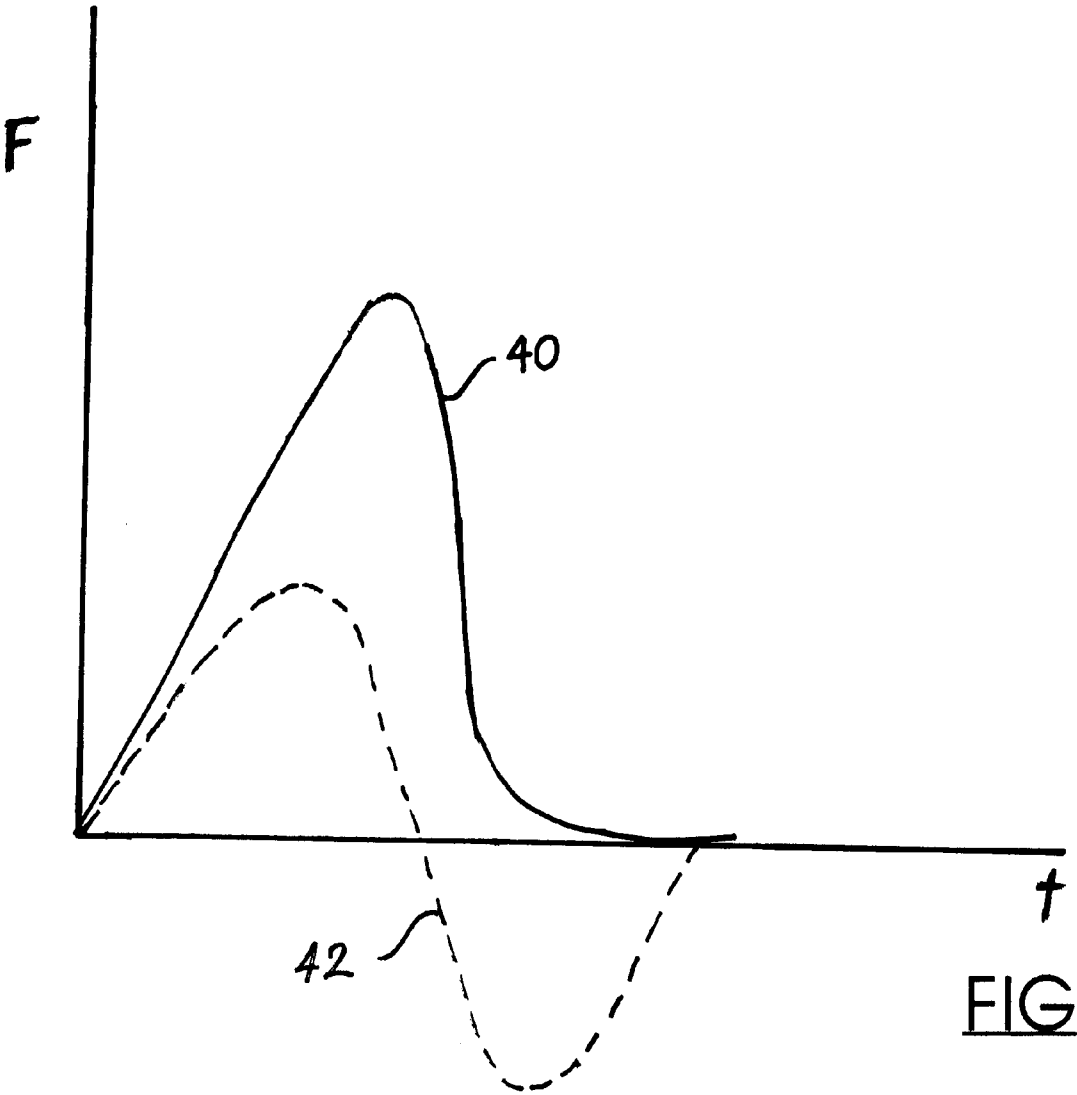
FIG. 4 is a plot of the force reflected onto a golf club during a golf stroke.

The principle of electronically discriminating strokes of the club which result in propulsion of the ball is now described with reference to FIGS. 3*a*–3*c*, and FIGS. 4*a*–4*b*. In FIGS. 3*a*–3*c*, a sequence of club positions is shown during the course of putting ball 18 to the left. Let r designate the distance between the center of mass (CM) of the ball and the surface of the ball at the point of contact with the club, while $r_0$ is the uncompressed value of r, i.e., the radius of the ball when it is not being struck. As a force F(t) is applied by club 10 as shown in FIG. 3*b*, ball 18 is compressed, with the distance between the struck surface of the ball and the CM of the ball varying as a function of time as $r(t)=r_0-F(t)/k$; where k is an effective spring modulus of the ball, which quantifies the Hooke's Law proportionality of force to displacement. The force of reaction against the club gives rise to acceleration a of the CM of the ball according to F=ma, where m is the mass of the ball. A plot of the force acting on the club head is shown in FIG. 4, with the force 40 decreasing as the potential energy of compression is converted to kinetic energy of the ball. The dominant Fourier spectral component of the waveform 40 is that of a sinusoid 42 of the frequency $\omega_0=(k/m)^{1/2}$ which is a frequency characteristic of standard golf balls.

The occurrence of a stroke of a ball is detected, in accordance with a preferred embodiment of the invention, by measuring the spectral power in the output signal of the transducer in a narrow spectral band surrounding the frequency $\omega_0$. This is a standard filtering process, and may be performed using any standard analog or digital signal processing techniques. The power in the target band may be normalized with respect to power in an unrelated frequency band in order to reject instances where broadband excitation of the club occurs due, for example, to the club being dropped or struck against another body besides the ball. In particular, the natural resonance of the club may be discriminated against in the detection algorithm. All techniques for detecting the presence of the natural resonance of the ball in the acoustic spectral content of the club are within the scope of the present invention, including, for example, temporal analysis of the shape of waveform 40.

Figure 5A:
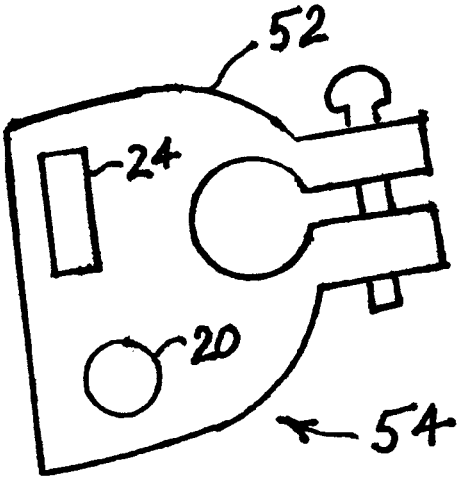
FIGS. 5*a*–5*d* show clip-on attachment of a stroke tally device in accordance with alternate embodiments of the present invention and FIG. 6 is a cut-away view of a head-mounted transducer in accordance with a further alternate embodiment of the present invention.
Figure 5B:
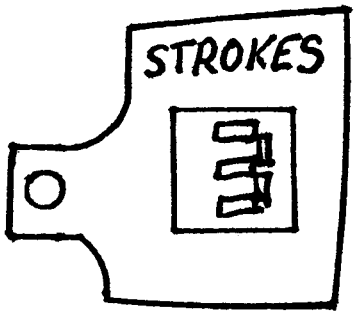
Figure 5C:
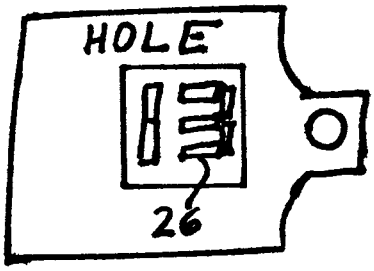
Figure 5D:
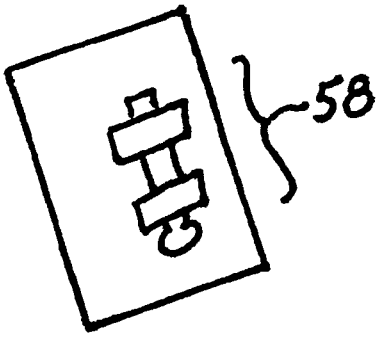
Figure 6:
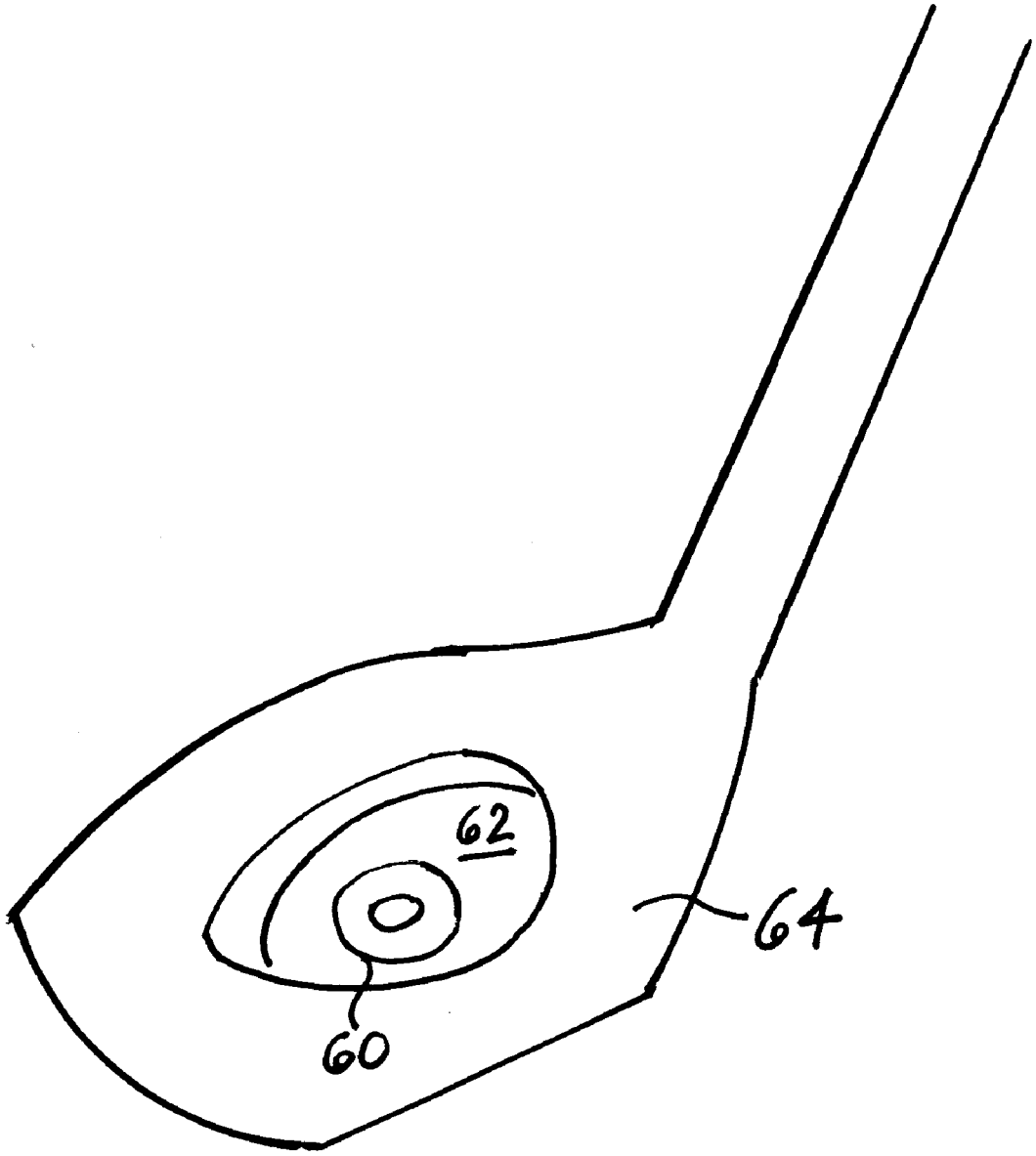

In accordance with an alternate embodiment of the invention, a clip-on design of golf score tally device 50 may be provided as shown in FIGS. 5*a*–5*d*. Transducer 20 and electronics module 24 are mounted integrally to block 52 which surrounds the shaft of a golf club, preferably near the head of the club. Display panels 26 on either side 54 of block 52 are shown in the side views of FIGS. 5*b* and 5*c*. The end view of FIG. 5*d* shows a clamping mechanism 58 for securing the tally device 50 about the golf club shaft. Referring now to FIG. 6, module 60, embedded in cavity 62 of hollow club head 64 may be provided, in accordance with an alternate embodiment of the invention, and contain the transducer and electronics module integrally within the club head.

The described embodiments of the invention are intended to be merely exemplary and numerous variations and modifications will be apparent to those skilled in the art. All such variations and modifications are intended to be within the scope of the present invention as defined in the appended claims.

We claim:

1. A method for recording a number of golf strokes taken on a golf course, the method comprising:

a. providing a golf club having a putting head;

b. measuring the spectral power in a spectral band surrounding a frequency characteristic of golf balls;

c. sensing any striking of a golf ball, and no other surface, by the putting head, based on the measured spectral power, for generating a stroke signal;

d. processing the stroke signal; and e. tallying a total number of strokes.

2. A method according to claim 1, further including the step of storing the total number of strokes in a memory.

3. A method according to claim 1, further including the step of displaying the total number of strokes.

4. A method for recording a number of golf strokes taken on a golf course as claimed in claim 1, further including the step of communicating with a central computer associated with the golf course for tallying scores of multiple players.

5. A method for recording a number of golf strokes taken on a golf course as claimed in claim 1, wherein the step of sensing any striking of a golf ball includes measuring the spectral power in a spectral band surrounding a frequency characteristic of golf balls.

6. A method for recording a number of golf strokes taken on a golf course as claimed in claim 1, wherein the step of sensing any striking of a golf ball includes analyzing an output waveform of a transducer disposed on the golf club.

7. A method for recording a number of golf strokes taken on a golf course as claimed in claim 6, wherein the step of sensing any striking of a golf ball includes temporal analysis of a shape of the waveform generated by the transducer in response to contact between the head and the golf ball.

* * * * *